US007667696B2

(12) United States Patent
Jang et al.

(10) Patent No.: US 7,667,696 B2
(45) Date of Patent: Feb. 23, 2010

(54) PLASMA DISPLAY APPARATUS

(75) Inventors: Ho Chul Jang, Daegu-si (KR); Yang Keun Lee, Gumi-si (KR); Sonic Kim, Incheon-si (KR); Chi Yun Ok, Gumi-si (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 11/325,412

(22) Filed: Jan. 5, 2006

(65) Prior Publication Data

US 2006/0267876 A1 Nov. 30, 2006

(30) Foreign Application Priority Data

May 24, 2005 (KR) ..... 10-2005-0043878
May 24, 2005 (KR) ..... 10-2005-0043879
May 24, 2005 (KR) ..... 10-2005-0043880

(51) Int. Cl.
*G09G 5/00* (2006.01)

(52) U.S. Cl. ..... 345/208; 345/60; 345/204; 345/210; 345/211

(58) Field of Classification Search ..... 345/60–68, 345/204–211
See application file for complete search history.

(56) References Cited

U.S. PATENT DOCUMENTS 5,184,117 A * 2/1993 Gauthier ..... 345/102
5,717,437 A * 2/1998 Sano et al. ..... 345/211
5,793,342 A * 8/1998 Rhoads ..... 345/76
6,157,357 A * 12/2000 Kim ..... 345/87
6,400,359 B1 * 6/2002 Katabami ..... 345/173
6,538,627 B1 * 3/2003 Whang et al. ..... 345/60
6,618,031 B1 * 9/2003 Bohn et al. ..... 345/83
7,034,468 B2 * 4/2006 Kim et al. ..... 315/169.4
7,106,320 B2 * 9/2006 Onozawa et al. ..... 345/211
2001/0054994 A1 12/2001 Hsu et al.
2004/0085263 A1 5/2004 Lee et al.
2004/0212562 A1 * 10/2004 Kim et al. ..... 345/60
2004/0263494 A1 * 12/2004 Poor et al. ..... 345/204

(Continued)

FOREIGN PATENT DOCUMENTS

CN 1337036 A 2/2002

(Continued)

OTHER PUBLICATIONS

Korean Office Action dated Jul 11, 2006.

(Continued)

*Primary Examiner*—Richard Hjerpe
*Assistant Examiner*—Gregory J Tryder
(74) *Attorney, Agent, or Firm*—Ked & Associates LLP

(57) ABSTRACT

The present invention relates to a plasma display apparatus, and more particularly, to a plasma display apparatus for preventing Electromagnetic Interference (EMI). The plasma display apparatus of the present invention comprises a plasma display panel comprising an electrode, and at least one of a first capacitor connected between a sustain voltage source for supplying a sustain voltage to the electrodes and a first ground voltage source, a second capacitor connected between a scan voltage source for supplying a scan voltage to the electrodes and a second ground voltage source, and a third capacitor connected between a set-up voltage source for supplying a set-up voltage to the electrodes and a third ground voltage source.

18 Claims, 11 Drawing Sheets

U.S. PATENT DOCUMENTS

| | | | |
|---|---|---|---|
| 2005/0068266 | A1 | 3/2005 | Sano et al. |
| 2006/0164372 | A1 | 7/2006 | Choi |

FOREIGN PATENT DOCUMENTS

| | | | |
|---|---|---|---|
| CN | 1525518 | A | 9/2004 |
| CN | 1536548 | A | 10/2004 |
| EP | 1152387 | | 11/2001 |
| EP | 1160756 | | 12/2001 |
| EP | 1598799 | | 11/2005 |
| JP | 02-029779 | | 1/1990 |
| KR | 10-2001-0101400 | A | 11/2001 |
| KR | 10-2004-0065711 | A | 7/2004 |
| WO | WO 01/35383 | A1 | 5/2001 |

OTHER PUBLICATIONS

Chinese Office dated Feb. 15, 2008.
European Search Report dated Apr. 7, 2009.

* cited by examiner (a)

(b)

(a)

(b)

PLASMA DISPLAY APPARATUS

CROSS-REFERENCES TO RELATED APPLICATIONS

This Nonprovisional application claims priority under 35 U.S.C. §119(a) on Patent Application Nos.10-2005-0043878 and 10-2005-0043879 and 10-2005-0043880 filed in Korea on May 24, 2005 the entire contents of which are hereby incorporated by reference.

BACKGROUND OF THE INVENTION

1. Field of the Invention

The present invention relates to a plasma display apparatus, and more particularly, to a plasma display apparatus for preventing Electromagnetic Interference (EMI).

2. Background of the Related Art

In general, a plasma display apparatus comprises a plasma display panel having a front panel and a rear panel. A barrier rib formed between the front panel and the rear panel forms one unit cell. Each cell is filled with an inert gas containing a primary discharge gas, such as neon (Ne), helium (He) or a mixed gas of Ne+He, and a small amount of xenon (Xe) . If the inert gas is discharged with a high frequency voltage, vacuum ultraviolet rays are generated. Phosphors formed between the barrier ribs are excited to implement images. The plasma display panel can be made thin, and has thus been in the spotlight as the next-generation display devices.

FIG. 1 illustrates a method of implementing gray levels of an image in a plasma display panel in the related art.

As shown in FIG. 1, to represent gray levels of an image of the plasma display panel in the related art, one frame is divided into several sub-fields having a different number of emissions. Each sub-field is divided into a reset period (RPD) for initializing the entire cells, an address period (APD) for selecting a cell to be discharged, and a sustain period (SPD) for implementing gray levels depending on the number of discharges. The sustain period is increased in the ratio of $2^n$ (where n=0, 1, 2, 3, 4, 5, 6, 7) in each sub-field. Since the sustain period is varied every sub-field as described above, gray levels of an image are represented by controlling the sustain period of each sub-field, i.e., a sustain discharge number.

FIG. 2 illustrates a driving waveform of a plasma display apparatus in the related art.

Referring to FIG. 2, each of sub-fields (SF) comprises a reset period (RP) for initializing discharge cells of the entire screen, an address period (AP) for selecting discharge cells, and a sustain period (SP) for sustaining the discharge of selected discharge cells.

In a set-up period (SU) of the reset period (RP), a ramp-up waveform (PR) is applied to the entire scan electrodes Y at the same time. A weak discharge (a set-up discharge) is generated within cells of the entire screen by the ramp-up waveform (PR), thus generating wall charges within the cells. In the set-up period (SD) of the reset period (RP), a ramp-down waveform (NR), which falls from a positive (+) sustain voltage (Vs) lower than a peak voltage of the ramp-up waveform (PR) to a negative scan voltage (−Vy) at a predetermined slant, is applied to the scan electrodes Y at the same time. The ramp-down waveform (NR) generates a weak erase discharge within the cells to erase wall charges generated by the set-up discharge and unnecessary charges of spatial charges, thus allowing wall charges necessary for an address discharge to uniformly remain within the cells of the entire screen.

In the address period (AP), while a negative (−) scan pulse (SCNP) is sequentially applied to the scan electrodes Y, a positive (+) data pulse (DP) is applied to address electrodes X. As a voltage difference between the scan pulse (SCNP) and the data pulse (DP) and a wall voltage generated in the reset period (RP) are added, an address discharge is generated within cells to which the data pulse (DP) is applied. Wall charges are generated within cells selected by an address discharge.

Meanwhile, during the set-up period (SD) and the address period (AP), a positive (+) sustain voltage (Vs) is applied to sustain electrodes Z.

In the sustain period (SP), a sustain pulse (SUSP) is alternately applied to the scan electrodes Y and the sustain electrodes Z. Therefore, a sustain discharge is generated in a surface discharge form between the scan electrodes Y and the sustain electrodes Z in cells selected by the address discharge whenever the sustain pulse (SUSP) is applied as the wall voltage within the cells and the sustain pulse (SUSP) are added. The sustain pulse (SUSP) has the same voltage value as the sustain voltage (Vs).

Meanwhile, in the related art plasma display apparatus, as the driving waveform is applied, EMI is generated toward the font of the plasma display panel.

More particularly, a pulse of a high frequency and a high voltage is applied to the scan electrodes in each of the set-up period, the address period and the sustain period. Therefore, a problem arises because a great amount of EMI is generated in the front of the plasma display panel due to the peaking component of the high frequency current of the pulse.

SUMMARY OF THE INVENTION

Accordingly, an object of the present invention is to solve at least the problems and disadvantages of the background art.

It is an object of the present invention to provide a plasma display apparatus in which EMI generated when a plasma display apparatus is driven can be prevented.

A plasma display apparatus according to an aspect of the present invention comprises a plasma display panel comprising an electrode, and at least one of a first capacitor connected between a sustain voltage source for supplying a sustain voltage to the electrodes and a first ground voltage source, a second capacitor connected between a scan voltage source for supplying a scan voltage to the electrodes and a second ground voltage source, and a third capacitor connected between a set-up voltage source for supplying a set-up voltage to the electrodes and a third ground voltage source.

A plasma display apparatus according to another aspect of the present invention comprises a plasma display panel comprising an electrode, and at least one of a first capacitor connected between a sustain voltage source for supplying a sustain voltage to the electrodes and a first ground voltage source, has a capacitance of about 0.1 μF to 2 μF, a second capacitor connected between a scan voltage source for supplying a scan voltage to the electrodes and a second ground voltage source, has a capacitance of about 0.1 μF to 2 μF, and a third capacitor connected between a set-up voltage source for supplying a set-up voltage to the electrodes and a third ground voltage source, has capacitance of about 0.5 μF to 6.0 μF.

The present invention is advantageous in that it can prevent EMI, which is generated when a pulse of a high frequency and a high voltage is supplied to the scan electrodes of the plasma display apparatus in each of the set-up period, the address period and the sustain period.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Figure 1:
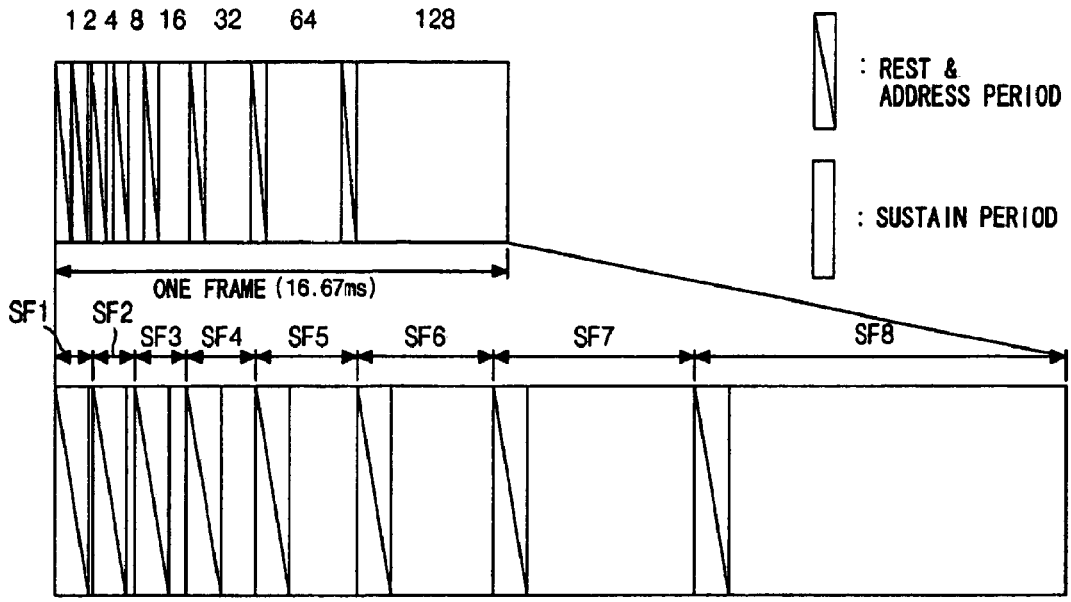
FIG. 1 illustrates a method of implementing gray levels of an image in a plasma display panel in the related art.
Figure 2:
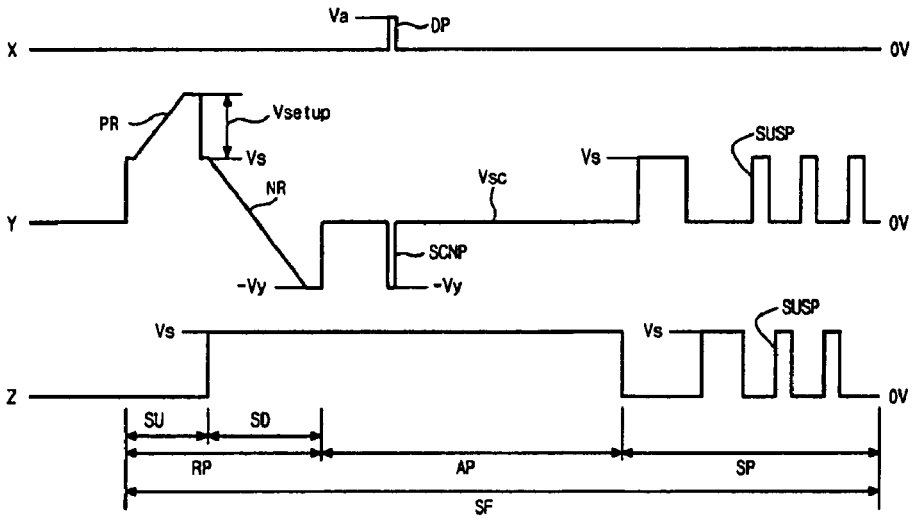
FIG. 2 illustrates a driving waveform of a plasma display apparatus in the related art.

Preferred embodiments of the present invention will be described in a more detailed manner with reference to the drawings.

A plasma display apparatus according to an aspect of the present invention comprises a plasma display panel comprising an electrode, and at least one of a first capacitor connected between a sustain voltage source for supplying a sustain voltage to the electrodes and a first ground voltage source, a second capacitor connected between a scan voltage source for supplying a scan voltage to the electrodes and a second ground voltage source, and a third capacitor connected between a set-up voltage source for supplying a set-up voltage to the electrodes and a third ground voltage source.

At least one of the first capacitor, the second capacitor and the third capacitor comprises at least one electrical element.

At least one of the first capacitor, the second capacitor and the third capacitor comprises a film capacitor.

The first capacitor, the second capacitor or the third capacitor comprises at least one capacitor.

At least one of the first capacitor, the second capacitor and the third capacitor is changed in the number of the capacitor and/or capacitance related to a frequency band of current.

The plasma display panel comprises a plurality of display electrodes comprising a scan electrode and a sustain electrode arranged in a front substrate, an upper dielectric layer formed on the display electrodes, a plurality of address electrodes arranged in a rear substrate coupled to the front substrate in a direction crossing the display electrodes, a lower dielectric layer formed on the address electrodes, a plurality of barrier ribs arranged in the rear substrate, for partitioning a discharge space, and phosphors coated between the barrier ribs.

At least one of the first capacitor, the second capacitor and the third capacitor is changed in capacitance and/or a frequency band to be filtered.

The first capacitor or the second capacitor filters a frequency band of about 70 MHz to 150 MHz.

The third capacitor filters a frequency band of about 20 MHz to 60 MHz.

The set-up voltage source is commonly connected with the sustain voltage source.

A plasma display apparatus according to another aspect of the present invention comprises a plasma display panel comprising an electrode, and at least one of a first capacitor connected between a sustain voltage source for supplying a sustain voltage to the electrodes and a first ground voltage source, has a capacitance of about 0.1 μF to 2 μF, a second capacitor connected between a scan voltage source for supplying a scan voltage to the electrodes and a second ground voltage source, has a capacitance of about 0.1 μF to 2 μF, and a third capacitor connected between a set-up voltage source for supplying a set-up voltage to the electrodes and a third ground voltage source, has capacitance of about 0.5 μF to 6.0 μF.

At least one of the first capacitor, the second capacitor and the third capacitor comprises at.least one electrical element.

At least one of the first capacitor, the second capacitor and the third capacitor comprises a film capacitor.

The first capacitor, the second capacitor or the third capacitor comprises at least one capacitor.

At least one of the first capacitor, the second capacitor and the third capacitor is changed in the number of the capacitor and/or capacitance related to a frequency band of current.

The plasma display panel comprises a plurality of display electrodes comprising a scan electrode and a sustain electrode arranged in a front substrate, an upper dielectric layer formed on the display electrodes, a plurality of address electrodes arranged in a rear substrate coupled to the front substrate in a direction crossing the display electrodes, a lower dielectric layer formed on the address electrodes, a plurality of barrier ribs arranged in the rear substrate, for partitioning a discharge space, and phosphors coated between the barrier ribs.

At least one of the first capacitor, the second capacitor and the third capacitor is changed in a frequency band to be filtered.

The first capacitor or the second capacitor filters a frequency band of about 70 MHz to 150 MHz.

The third capacitor filters a frequency band of about 20 MHz to 60 MHz.

The set-up voltage source is commonly connected with the sustain voltage source.

A plasma display apparatus according to the present invention will now be described in connection with preferred embodiments with reference to the accompanying drawings.

Figure 3:
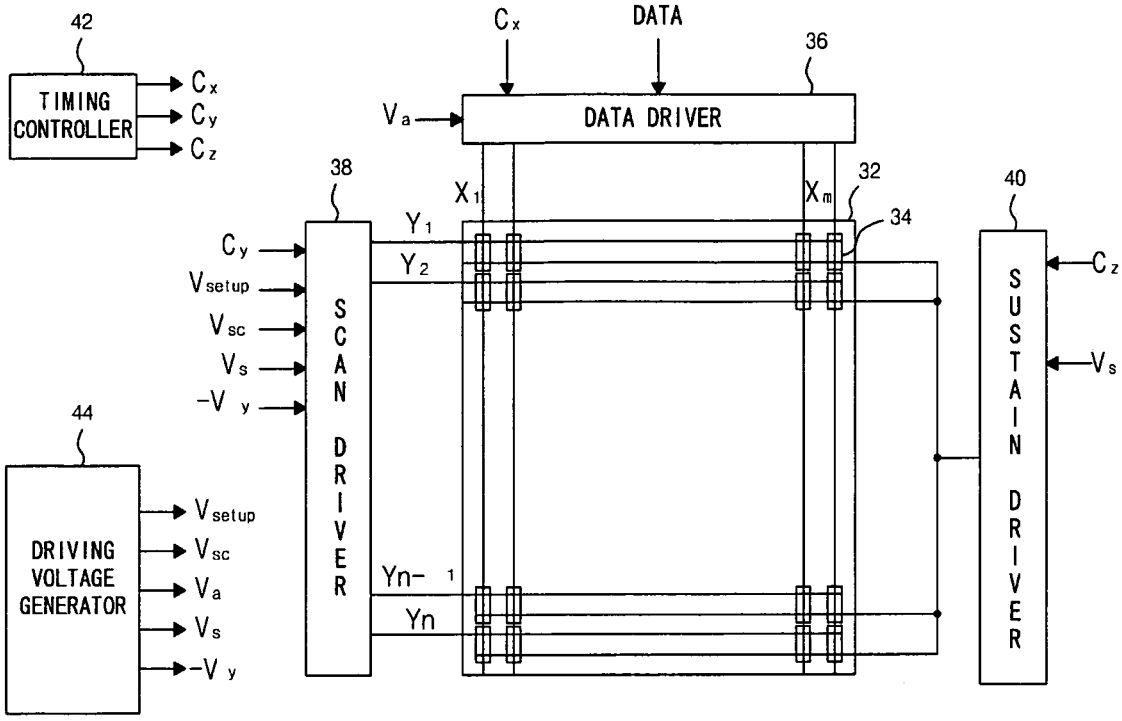
FIG. 3 illustrates the construction of a plasma display apparatus according to an embodiment of the present invention.

FIG. 3 illustrates the construction of a plasma display apparatus according to an embodiment of the present invention.

Referring to FIG. 3, the plasma display apparatus according to an embodiment of the present invention comprises a plasma display panel 32 that displays images, a data driver 36 that supplies data to address electrodes X1 to Xm, a scan driver 38 that drives scan electrodes Y1 to Yn, a sustain driver 40 that drives sustain electrodes Z, a timing controller 42 that controls the respective drivers 36, 38 and 40, and a driving voltage generator 44 that supplies driving voltages necessary for the respective drivers 36, 38 and 40.

The plasma display panel 32 includes a front substrate (not shown) in which display electrodes comprising the scan electrodes Y1 to Yn and the sustain electrodes Z are formed, and a rear substrate (not shown) in which the address electrodes X1 to Xm are formed.

In the front substrate, an upper dielectric layer (not shown) on which wall charges are accumulated, and a protection film (not shown) that protects damage to the upper dielectric layer due to sputtering during the discharge of plasma are laminated on the scan electrodes Y1 to Yn and the sustain electrodes Z.

In the rear substrate, a lower dielectric layer (not shown) on which wall charges are accumulated below the address electrodes X1 to Xm. In the plasma display panel 32 constructed above, discharge cells 34 are formed at regions where the scan electrodes Y1 to Yn, the sustain electrodes Z and the address electrodes X1 to Xm. The discharge cells 34 are partitioned into discharge spaces by barrier ribs (not shown) formed in the rear substrate. Red, green and blue phosphors are coated on the inner surface of the discharge cells 34.

The plasma display panel 32 selects the discharge cells 34 using an address pulse and a scan pulse applied to the address electrodes X1 to Xm and the scan electrodes Y1 to Yn, respectively, and sustains a sustain discharge using a sustain pulse applied to the scan electrodes Y1 to Yn and the sustain electrodes Z. Therefore, in the discharge cells 34, the phosphors coated on the inner surfaces of the discharge cells 34 radiate a visible ray by way of ultraviolet rays generated upon sustain discharge, implementing images.

The data driver 36 samples and latches image signal data in response to a timing control signal (Cx) supplied from the timing controller 42, and then supplies the address pulse having a data voltage (Va) to the address electrodes X1 to Xm.

The scan driver 38 supplies a reset pulse to the scan electrodes Y1 to Yn during the reset period in response to a timing control signal (Cy) supplied from the timing controller 42. The scan driver 38 then supplies a scan reference voltage (Vsc) to the scan electrodes Y1 to Yn during the address period and also sequentially supplies the scan pulse having a negative scan voltage (−Vy) to the scan electrodes Y1 to Yn. Furthermore, the scan driver 38 supplies the sustain pulse having a sustain voltage level (Vs) and a ground voltage level (GND) to the scan electrodes Y1 to Yn during the sustain period under the control of the timing controller 42.

The scan driver 38 according to an embodiment of the present invention comprises at least one of a first capacitor, a second capacitor and a third capacitor in order to filter a current peaking component of a pulse supplied in each period.

For example, the scan driver 38 can comprise the first capacitor. In this case, the first capacitor can filter a peaking component of current generated by the sustain voltage (Vs) and supply the filtered sustain pulse to the scan electrodes Y1 to Yn.

Furthermore, the scan driver 38 can comprise the second capacitor. In the case, the second capacitor can filter a peaking component of current generated by the negative scan voltage (−Vy) and can supply the filtered negative scan voltage (−Vy) to the scan electrodes Y1 to Yn. That is, the scan driver 38 can supply a set-down pulse and a scan pulse, which have been filtered through the second capacitor, to the scan electrodes Y1 to Yn.

Furthermore, the scan driver 38 can comprise the third capacitor. In the case, the third capacitor can filter a peaking component of current generated by the sustain voltage (Vs) and a set-up voltage (Vsetup) and can supply the filtered set-up pulse to the scan electrodes Y1 to Yn. This will be described in more detail with reference to FIGS. 4 to 12.

In this case, at least one of the first, second and third capacitors can have a different capacitance and/or frequency band to be filtered, if appropriate. The first, second and third capacitors will be described in more detail later on with reference to FIGS. 4 to 12.

The sustain driver 40 supplies the positive voltage (Vs) to the sustain electrodes Z during the set-down period and the address period in response to a timing control signal (Cz) supplied from the timing controller 42. The sustain driver 40 then operates alternately with the scan driver 38 during the sustain period to supply the sustain pulse having the sustain voltage level (Vs) and the ground voltage level (GND) to the sustain electrodes Z.

The timing controller 42 receives vertical/horizontal sync signals and a clock signal, and generates timing control signals (Cx, Cy and Cz) necessary for the respective drivers 36, 38 and 40. The timing controller 42 provides the generated timing control signals (Cx, Cy and Cz) to corresponding drivers 36, 38 and 40, thus controlling the respective drivers 36, 38 and 40. The data control signal (Cx) comprises a sampling clock for sampling data, a latch control signal, and a switching control signal for controlling an on/off time of an energy recovery circuit and a driving switch element. The scan control signal (Cy) comprises a switching control signal for controlling an on/off time of an energy recovery circuit and a driving switch element within the scan driver 38. The sustain control signal (Cz) comprises a switching control signal for controlling an on/off time of an energy recovery circuit and a driving switch element within the sustain driver 40.

The driving voltage generator 44 generates a set-up voltage (Vsetup), a scan voltage (−Vy), a scan reference voltage (Vsc), a positive sustain voltage (Vs), a data voltage (Vd) and the like. The driving voltage generator 44 supplies the generated driving voltages to the respective drivers 36, 38 and 40. The driving voltage generator 44 also supplies a voltage for driving the timing controller 42.

The plasma display apparatus according to an embodiment of the present invention comprises at least one of first to third capacitors in the scan driver in order to reduce EMI by filtering a current peaking component of pulses applied to the scan electrodes, respectively. An example of reducing a current peaking component generated when the sustain voltage is supplied will be described with reference to FIGS. 4 to 6.

Figure 4:
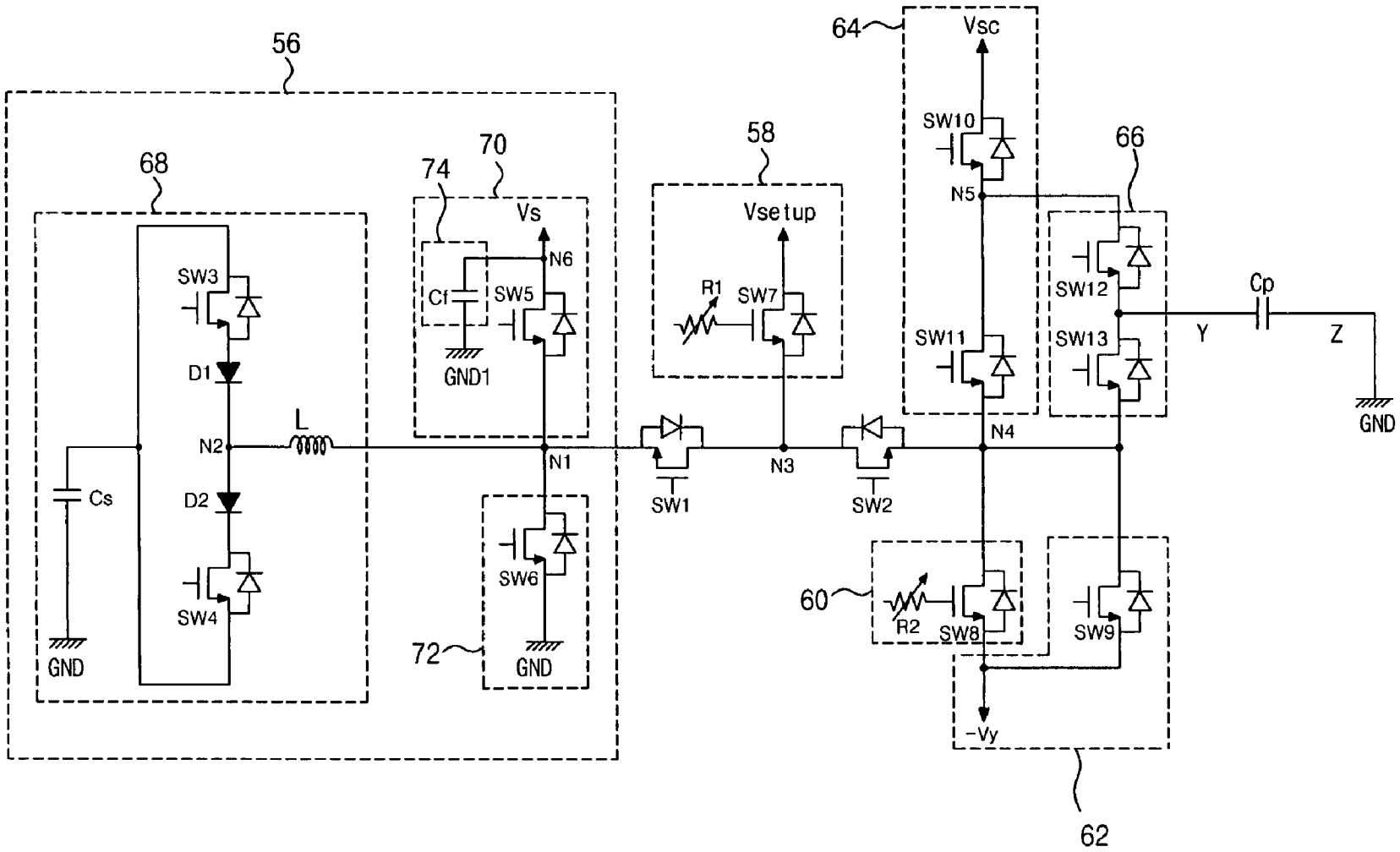
FIG. 4 illustrates a scan driver according to an embodiment of the present invention.

FIG. 4 illustrates a scan driver according to an embodiment of the present invention.

Referring to FIG. 4, the scan driver according to an embodiment of the present invention comprises a sustain pulse supply unit 56 that filters a peaking component of current generated by the sustain voltage (Vs), i.e., noise and supplies a filtered sustain voltage (Vs) and a filtered ground voltage (GND) to the scan electrode Y of a panel capacitor Cp, a set-up voltage supply unit 58 that supplies the set-up voltage (Vsetup) to the scan electrode Y of the panel capacitor Cp, a set-down voltage supply controller 60 that controls a ramp-down pulse, which falls from the sustain voltage (Vs) to the negative scan voltage (−Vy) at a predetermined slant, to be supplied to the scan electrode Y of the panel capacitor Cp, a scan voltage supply unit 62 that supplies the negative scan voltage (−Vy) to the scan electrode Y of the panel capacitor Cp, the scan reference voltage supply unit 64 that supplies the scan reference voltage (Vsc) to the scan electrode Y of the panel capacitor Cp, a scan integrated circuit (hereinafter referred to as "IC") 66 connected between the scan voltage supply unit 62 and the scan reference voltage supply unit 64 and between the scan voltage supply unit 62 and the scan electrode Y of the panel capacitor Cp in a push-pull form, and a first switch SW1 and a second switch SW2.

The panel capacitor Cp equivalently shows capacitance formed between the scan electrode Y of the plasma display panel and the sustain electrode Z.

The sustain pulse supply unit 56 supplies the sustain voltage and the ground voltage to the scan electrode Y of the panel capacitor Cp in the reset period and the sustain period according to the timing control signal output from the timing controller. The sustain pulse supply unit 56 filters a peaking component of a high frequency current, of a current generated when the sustain voltage (Vs) is supplied to the scan electrode Y of the panel capacitor Cp, noise using a first capacitor 74, and then supplies the filtered sustain voltage (Vs) to the scan electrode Y of the panel capacitor Cp.

The sustain pulse supply unit 56 comprises an energy recovery/supply unit 68, a sustain voltage supply unit 70 and a ground voltage supply unit 72. The energy recovery/supply unit 68 is connected to a first node N1 between the sustain voltage supply unit 70 and the ground voltage supply unit 72, and it recovers energy of reactive power, which does not contribute to a discharge in the panel capacitor Cp, and also supplies recovered energy to the scan electrode Y of the panel capacitor Cp. The energy recovery/supply unit 68 recovers energy stored in the panel capacitor Cp and supplies the recovered energy to the scan electrode Y of the panel capacitor Cp using the sustain voltage (Vs).

The energy recovery/supply unit 68 comprises a source capacitor Cs that stores energy recovered from the scan electrode Y of the panel capacitor Cp, an inductor L connected between the source capacitor Cs and the first node N1, a third switch SW3 and a first diode D1 connected in series between the source capacitor Cs and the inductor L in order to form a current path for supplying the energy stored in the source capacitor Cs to the scan electrode Y of the panel capacitor Cp, and a second diode D2 and a fourth switch SW4 connected in series between a second node N2 disposed between the first diode D1 and the inductor L, and the source capacitor Cs in order to form a current path for recovering the energy stored in the panel capacitor Cp. The third switch SW3 and the first diode D1, and the second diode D2 and the fourth switch SW4 are connected in parallel between the source capacitor Cs and the inductor L.

The source capacitor Cs recovers energy charged in the panel capacitor Cp and re-supplies the recovered energy the scan electrode Y of the panel capacitor Cp using the sustain voltage (Vs).

The inductor L stores energy supplied from the panel capacitor Cp and supplies the panel capacitor Cp with energy stored by LC resonance with the panel capacitor Cp.

The third switch SW3 is connected between the source capacitor Cs and the second node N2, and forms a current path so that energy stored in the source capacitor Cs is supplied to the scan electrode Y of the panel capacitor Cp in response to a third switching control signal output from the timing controller.

The first diode D1 is connected between the third switch SW3 and the second node N2, and prevents an inverse current from the panel capacitor Cp when energy charged into the source capacitor Cs is supplied to the scan electrode Y of the panel capacitor Cp.

The fourth switch SW4 is connected between the second node N2 and the source capacitor Cs, and forms a current path so that energy stored in the panel capacitor Cp is recovered by the source capacitor Cs in response to a fourth switching control signal output from the timing controller.

The second diode D2 is connected between the second node N2 and the fourth switch SW4, and prevents an inverse current from the source capacitor Cs when energy stored in the panel capacitor Cp is recovered by the source capacitor Cs.

The sustain voltage supply unit 70 is connected to the first node N1, and it supplies the sustain voltage (Vs) to the scan electrode Y of the panel capacitor Cp during the set-up period of the reset period and also supplies the sustain voltage (Vs) to the scan electrode Y of the panel capacitor Cp during the sustain period. The sustain voltage supply unit 70 filters a peaking component of a high frequency current from the sustain voltage source (Vs) using the first capacitor 74 and supplies the scan electrode Y of the panel capacitor Cp with the filtered sustain voltage (Vs). The sustain voltage supply unit 70 comprises a sustain voltage source (Vs), a fifth switch SW5 connected between the first node N1 and the sustain voltage source (Vs), and a first capacitor 74 connected between a sixth node N6 disposed between the sustain voltage source (Vs) and the fifth switch SW5, and a first ground voltage source (GND1).

The fifth switch SW5 is connected between the sustain voltage source (Vs) and the first node N1, and electrically connects the second node N2 to the first node N1 in response to a fifth switching control signal output from the timing controller. Therefore, a filter sustain voltage (Vs) is transferred from the first capacitor 74 to the first node N1 during the set-up period of the reset period and the sustain period.

The first capacitor 74 is connected between the sixth node N6 and the first ground voltage source (GND1), i.e., to the supply path of the sustain voltage (Vs). In the present embodiment of the present invention, it has been described that the first capacitor is directly connected between the sustain voltage source (Vs) and the first ground voltage source. However, the first capacitor may be connected between the sustain voltage source (Vs) and the first ground voltage source, while comprising at least one electrical element, if needed.

The first capacitor 74 includes a film capacitor Cf. The first capacitor 74 consists of one or more film capacitors Cf. For example, the number of the film capacitor Cf or the capacitance of the film capacitor Cf may be varied depending on the frequency band of a current to be filtered.

Furthermore, in the case where the film capacitor Cf is formed in plural numbers, the plurality of the film capacitors Cf can be connected between the sixth node N6 and the first ground voltage source (GND1) in parallel or series according to the frequency band of a current to be filtered. That is, in the case where the frequency band of a current to be filtered is to be widened, the film capacitors Cf can be connected in parallel. In the case where the frequency band of a current to be-filtered is to be narrowed, the film capacitors Cf can be connected in series. This is because when the sustain voltage (Vs) is supplied to the panel capacitor Cp, the band gap of a resonance frequency is controlled according to a capacitance value of the film capacitor Cf and a frequency band to be filtered is controlled accordingly. The first capacitor according to an embodiment of the present invention filters a frequency band of about 70 MHz to 150 MHz, thus filtering a peaking component of a high frequency current generated by the sustain voltage (Vs). To this end, the first capacitor can have capacitance of about 0.1 μF to 1.0 μF.

The ground voltage supply unit 72 is connected to the first node N1, and supplies the scan electrode Y with the ground voltage (GND) during the sustain period. The ground voltage supply unit 72 comprises a ground voltage source (GND) and a sixth switch SW6.

The sixth switch SW6 is connected between the first node N1 and the ground voltage source (GND) and electrically connects the ground voltage source (GND) to the first node N1 in response to a sixth switching control signal output from the timing controller. Therefore, the ground voltage (GND) is transferred to the first node N1 during the sustain period.

The energy recovery/supply unit 68, the sustain voltage supply unit 70 and the ground voltage supply unit 72 are used as an energy recovery circuit.

The set-up voltage supply unit 58 is connected to a third node N3 between a first switch SW1 and a second switch SW2, and supplies the scan electrode Y of the panel capacitor Cp with a ramp-up waveform that rises from the sustain voltage (Vs) to a peak voltage (Vs+Vsetup) at a predetermined slant during the set-up period of the reset period. To this end, a filtered sustain voltage (Vs) is supplied from the sustain voltage supply unit 70 to the third node N3 during the set-up period of the reset period. The set-up voltage supply unit 58 comprises a set-up voltage source (Vsetup), a seventh switch SW7 and a first variable resistor R1.

The seventh switch SW7 is connected between the set-up voltage source (Vsetup) and the third node N3 and electrically connects the set-up voltage source (Vsetup) to the third node N3 in response to a seventh switching control signal output from the timing controller.

The first variable resistor R1 is connected to a gate terminal of the seventh switch SW7, and controls a slant of the set-up voltage (Vsetup) supplied from the set-up voltage source (Vsetup). Therefore, the set-up voltage (Vsetup) supplied from the set-up voltage source (Vsetup) has a predetermined slant.

The set-down voltage supply controller 60 is connected between a fourth node N4, i.e., a common terminal of the second switch SW2, the scan reference voltage supply unit 64 and the scan IC 66, and a scan voltage source (−Vy), and controls a ramp-down waveform, which falls from the sustain voltage (Vs) to the scan voltage (−Vy) at a predetermined slant, to be supplied to the scan electrode Y of the panel capacitor Cp during the set-down period of the reset period. The set-down voltage supply controller 60 comprises an eighth switch SW8 and a second variable resistor R2.

The eighth switch SW8 is connected between the fourth node N4 and the scan voltage source (−Vy), and transfers the scan voltage (−Vy), which is received from the scan voltage source (−Vy), to the fourth node N4 in response to an eighth switching control signal output from a timing controller (not shown) . The scan voltage (−Vy) transferred to the fourth node N4 has a predetermined slant.

The second variable resistor R2 is connected to a gate terminal of the eighth switch SW8, and controls the slant of the scan voltage (−Vy) received from the scan voltage source (−Vy). Therefore, the scan voltage (−Vy) supplied from the scan voltage source (−Vy) during the set-down period of the reset period has a predetermined slant. That is, during set-down period of the reset period, the fourth node N4 is supplied with the scan voltage (−Vy) having a predetermined slant.

The scan voltage supply unit 62 is connected in parallel to the set-down voltage supply controller 60 and the fourth node N4, and supplies the scan electrode Y of the panel capacitor Cp with a scan pulse having the scan voltage level (−Vy) during the address period. The scan voltage supply unit 62 comprises a ninth switch SW9.

The ninth switch SW9 is connected parallel to the eighth switch SW8 between the fourth node N4 and the scan voltage source (−Vy), and transfers the scan voltage (−Vy), which is received from the scan voltage source (−Vy), to the fourth node N4 in response to a ninth switching control signal output from the timing controller. Therefore, the scan voltage (−Vy) is transferred to the fourth node N4 during the address period and the sustain period.

The scan reference voltage supply unit 64 is connected between the fourth node N4 and the scan IC 66, and supplies the scan reference voltage (Vsc) to the scan electrode Y of the panel capacitor Cp during the address period. The scan reference voltage supply unit 64 comprises a scan reference voltage source (Vsc), and a tenth switch SW10 and an eleventh switch SW11 connected in series between the scan reference voltage source (Vsc) and the fourth node N4.

The tenth switch SW10 is connected between the scan reference voltage source (Vsc) and the scan IC 66, and electrically connects the scan reference voltage source (Vsc) to a fifth node N5, i.e., a common terminal of the eleventh switch SW11 and the scan IC 66 in response to a tenth switching control signal output from the timing controller. Therefore, during the address period, the fifth node N5 is supplied with the scan reference voltage (Vsc).

The eleventh switch SW11 is connected between the fifth node N5 and the fourth node N4, and electrically connects the fifth node N5 and the fourth node N4 in response to an eleventh switching control signal output from the timing controller. Therefore, a voltage applied to the fifth node N5 is transferred to the fourth node N4, and a voltage applied to the fourth node N4 is transferred to the fifth node N5.

The scan IC 66 comprises a twelfth switch SW12 and a thirteenth switch SW13 that are connected in a push-pull form between the fifth node N5, the fourth node N4 and the scan electrode Y of the panel capacitor Cp. An output terminal between the twelfth switch SW12 and the thirteenth switch SW13 is connected to the scan electrode Y of the panel capacitor Cp.

The twelfth switch SW12 is connected between the fifth node N5 and the scan electrode Y of the panel capacitor Cp, and supplies a voltage, which is supplied to the fifth node N5 via its body diode, to the scan electrode Y of the panel capacitor Cp. In other words, the twelfth switch SW12 supplies a voltage, which is applied to the fifth node N5, to the scan electrode Y of the panel capacitor Cp by electrically connecting the scan electrode Y of the panel capacitor Cp to the fifth node N5 via its body diode. The fifth node N5 is supplied with a negative voltage. Therefore, the scan electrode Y of the panel capacitor Cp is supplied with a voltage, which is low as much as the negative voltage applied to the fifth node N5.

The thirteenth switch SW13 is connected between the fourth node N4 and the scan electrode Y of the panel capacitor Cp, and supplies the scan electrode Y of the panel capacitor Cp with a voltage applied to the fourth node N4 via its body diode. In other words, the thirteenth switch SW13 supplies a voltage, which is applied to the fourth node N4, to the scan electrode Y of the panel capacitor Cp by electrically connecting the fourth node N4 to the scan electrode Y of the panel capacitor Cp via its body diode. At this time, the fourth node N4 is supplied with a positive voltage. Therefore, the scan electrode Y of the panel capacitor Cp is supplied with a voltage, which is high as much as the positive voltage applied to the fourth node N4.

The first switch SW1 is connected between the first node N1 and the third node N3, and electrically connects the first node N1 to the third node N3 via its body diode. Therefore, a voltage from the energy recovery/supply unit 68, the sustain voltage supply unit 70 and the ground voltage supply unit 72 is transferred from the first node N1 to the third node N3 via the body diode of the first switch SW1. That is, the first switch SW1 forms an energy supply path along which energy is supplied to the panel capacitor Cp using its body diode. Furthermore, the first switch SW1 electrically connects the third node N3 to the first node N1 in response to the first switching control signal output from the timing controller. Therefore, energy of reactive power, which does not contribute to a discharge in the panel capacitor Cp, is transferred from the third node N3 to the first node N1. That is, the first switch SW1 forms an energy recovery path along which energy output from the panel capacitor Cp is transferred to the energy recovery/supply unit 68 in response to the first switching control signal.

The second switch SW2 is connected between the third node N3 and the fourth node N4, and electrically connects the fourth node N4 to the third node N3 via its body diode. Therefore, energy of reactive power, which does not contribute to a discharge in the panel capacitor Cp, is transferred from the fourth node N4 to the third node N3. That is, the second switch SW2 forms an energy recovery path along which energy output from the panel capacitor Cp is transferred to the energy recovery/supply unit 68 using its body diode. Furthermore, the second switch SW2 electrically connects the third node N3 to the fourth node N4 in response to the second switching control signal output from the timing controller. Therefore, a voltage applied to the third node N3 is transferred to the fourth node N4. That is, the second switch SW2 forms an energy supply path along which energy is supplied to the panel capacitor Cp in response to the second switching control signal output from the timing controller.

These switches SW1 to SW13 are formed of a field effect transistor having built a body diode therein.

Figure 5:
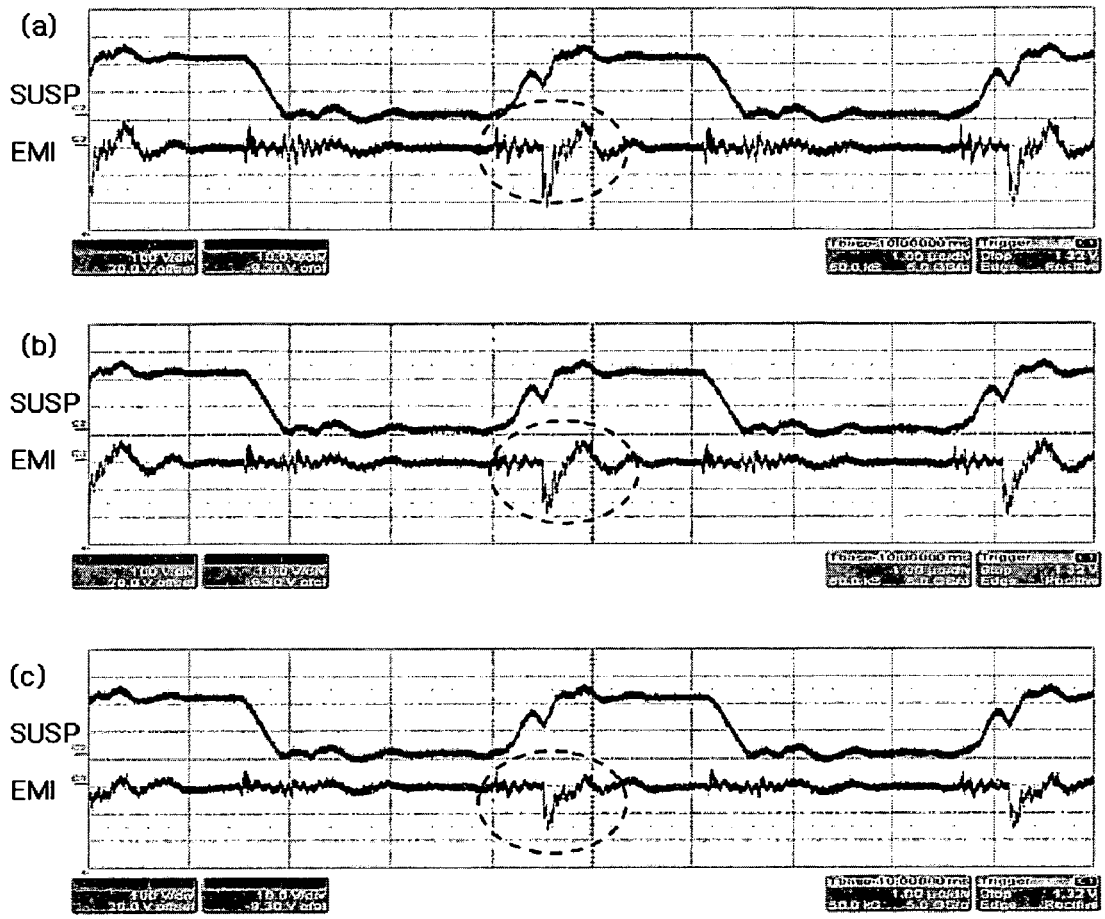
FIG. 5 illustrates EMI generated when the plasma display apparatus according to an embodiment of the present invention is driven.

FIG. 5 illustrates EMI generated when the plasma display apparatus according to an embodiment of the present invention is driven.

Referring to FIG. 5, (a) shows a sustain pulse (SUSP) in the related art and EMI generated accordingly, and (b) and (c) show a sustain pulse (SUSP) according to an embodiment of the present invention and EMI generated accordingly. (b) shows a case where capacitance of the first capacitor is 0.1 μF and (c) shows a case where capacitance of the first capacitor is 1.0 μF.

From a region indicated by a dotted line, it can be seen that EMI in (b) and (c) is reduced in comparison with (a) . More particularly, as shown in (c), it can be seen that generation of EMI is significantly reduced when the capacitance of the first capacitor is 1.0 μF.

Figure 6:
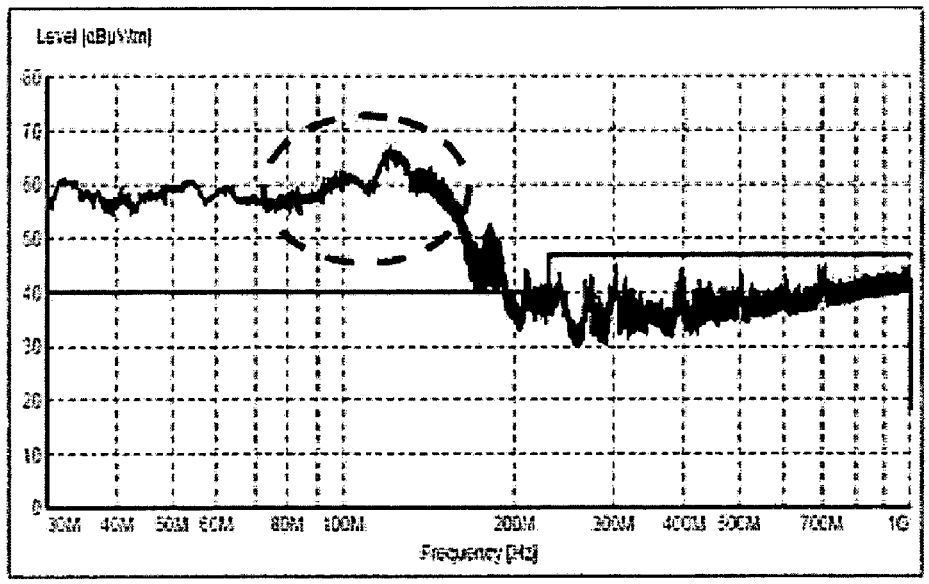
FIG. 6 illustrates a frequency band in which generation of EMI is prevented according to an embodiment of the present invention.
Figure 6:
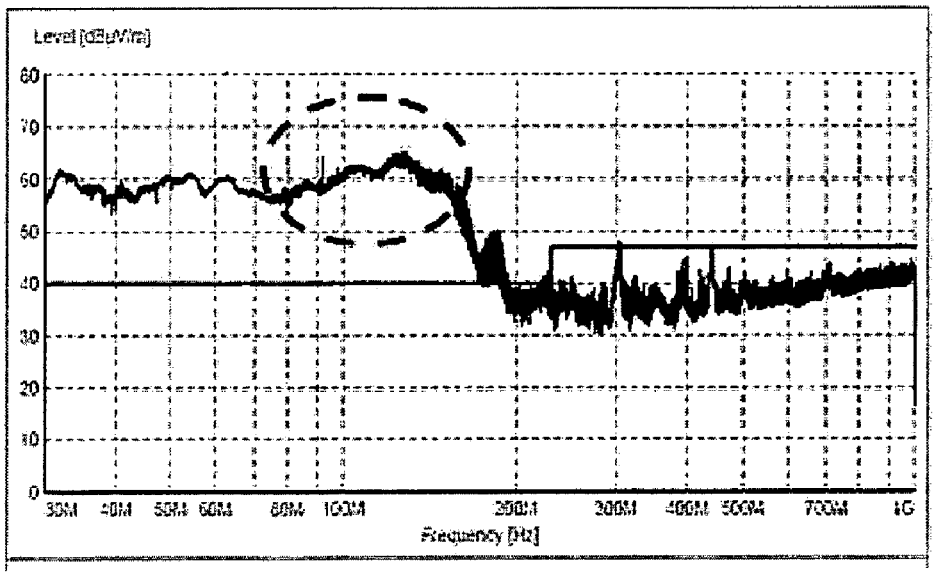

FIG. 6 illustrates a frequency band in which generation of EMI is prevented according to an embodiment of the present invention.

Referring to FIG. 6, (a) shows that EMI was generated at a frequency band of about 70 MHz to 150 MHz during the sustain period in the prior art plasma display apparatus and (b) shows that EMI was reduced at a frequency band of about 70 MHz to 150 MHz by using the first capacitor having capacitance of about 0.1 μF to 1.0 μF in the plasma display apparatus according to an embodiment of the present invention. More particularly, in the case where the first capacitor having capacitance of 1.0 μF is used, EMI generated during the sustain period can be reduced to about 3 dB μV/m in comparison with the prior art plasma display apparatus.

An example of reducing a current peaking component generated when a scan voltage is applied will be described below with reference to FIGS. 7 to 9.

Figure 7:
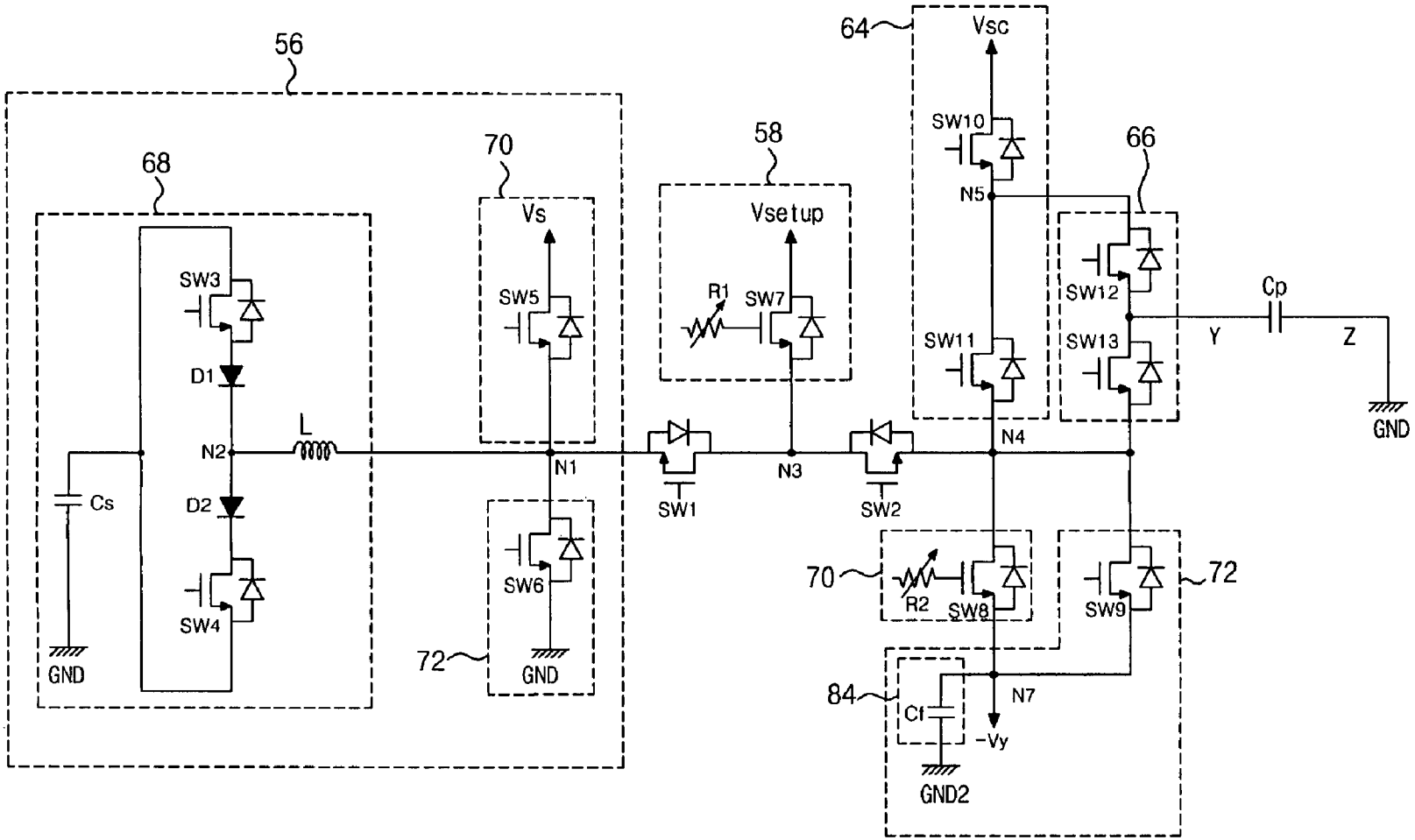
FIG. 7 illustrates a scan driver according to another embodiment of the present invention.

FIG. 7 illustrates a scan driver according to another embodiment of the present invention.

Referring to FIG. 7, the scan driver according to another embodiment of the present invention comprises a sustain pulse supply unit 56 that supplies a sustain pulse having a voltage level of the sustain voltage (Vs) and the ground voltage (GND) to the scan electrode Y of the panel capacitor Cp, a set-up voltage supply unit 58 that supplies the set-up voltage (Vsetup) to the scan electrode Y of the panel capacitor Cp, and a scan voltage supply unit 72 that filters a peaking component of a high frequency current generated by the negative scan voltage (−Vy) and supplies the filtered negative scan voltage (−Vy) to the scan electrode Y of the panel capacitor Cp. The scan driver further comprises a set-down voltage supply controller 70 that controls a ramp-down pulse, which falls from the sustain voltage (Vs) to the filtered scan voltage (−Vy), to the scan electrode Y of the panel capacitor Cp, a scan reference voltage supply unit 64 that supplies the scan reference voltage (Vsc) to the scan electrode Y of the panel capacitor Cp, and a scan IC 66, a first switch SW1 and a second switch SW2 that are connected in a push-pull form between the scan voltage supply unit 72, and the scan reference voltage supply unit 64 and the scan electrode Y of the panel capacitor Cp.

The scan voltage supply unit 72 according to another embodiment of the present invention is connected to a fourth node N4, i.e., a common terminal of the scan reference voltage supply unit 64 and the scan IC 66. The scan voltage supply unit 72 filters a peaking component of a high frequency current generated by the negative scan voltage (−Vy) and supplies a scan pulse having the filtered negative scan voltage (−Vy) to the scan electrode Y of the panel capacitor Cp during the address period. The scan voltage supply unit 72 comprises a scan voltage source (−Vy), a ninth switch SW9 connected between the scan voltage source (−Vy) and the fourth node N4, and a second capacitor 84 connected between a seventh node N7, i.e., a common terminal of the scan voltage source (−Vy) and the ninth switch SW9, and the second ground voltage source (GND2).

The ninth switch SW9 is connected parallel to the set-down voltage supply controller 70 between the fourth node N4 and the seventh node N7, and transfers the scan voltage (−Vy), which is filtered by the second capacitor 84, to the fourth node N4 in response to a ninth switching control signal output from a timing controller (not shown).

The second capacitor 84 is connected between the seventh node N7 and the second ground voltage source (GND2) . In the present embodiment, it has been described that the second capacitor is directly connected between the scan voltage source (−Vy) and the second ground voltage source (GND2) . However, the second capacitor can be connected between the scan voltage source (−Vy) and the second ground voltage source, including at least one electrical element, if appropriate.

Meanwhile, the second capacitor 84 consists of a film capacitor Cf similar to the first capacitor 74 shown in FIG. 4. the number, a connection form when being plural in number, a filtered frequency band, the range of capacitance and the like, of the second capacitor 84, are substantially the same as those of the first capacitor 74.

The set-down voltage supply controller 70 is connected between the fourth node N4 and the seventh node N7, and controls a ramp-down pulse, which falls from the sustain voltage (Vs) to the scan voltage (−Vy) filtered by the second capacitor 84 at a predetermined slant, to be supplied to the scan electrode Y of the panel capacitor Cp during the set-down period of the reset period. The set-down voltage supply controller 70 comprises an eighth switch SW8 and a second variable resistor R2.

The eighth switch SW8 is connected parallel to the ninth switch SW9 between the fourth node N4 and the seventh node N7, and transfers the scan voltage (−Vy) filtered by the second capacitor 84 to the fourth node N4 in response to an eighth switching control signal output from the timing controller.

The second variable resistor R2 is connected to a gate terminal of the eighth switch SW8, and controls the slant of the scan voltage (−Vy) filtered by the second capacitor 84. Therefore, the scan voltage (−Vy) supplied from the scan voltage source (−Vy) has a predetermined slant during the set-down period of the reset period.

As described above, the plasma display apparatus according to another embodiment of the present invention can reduce EMI generated in the address period and the set-down period by filtering a peaking component of a high frequency current of the scan voltage (−Vy). The remaining constituent elements have substantially the same operating characteristic of the scan driver according to an embodiment of the present invention of FIG. 4. Therefore, description thereof will be omitted for simplicity.

Figure 8:
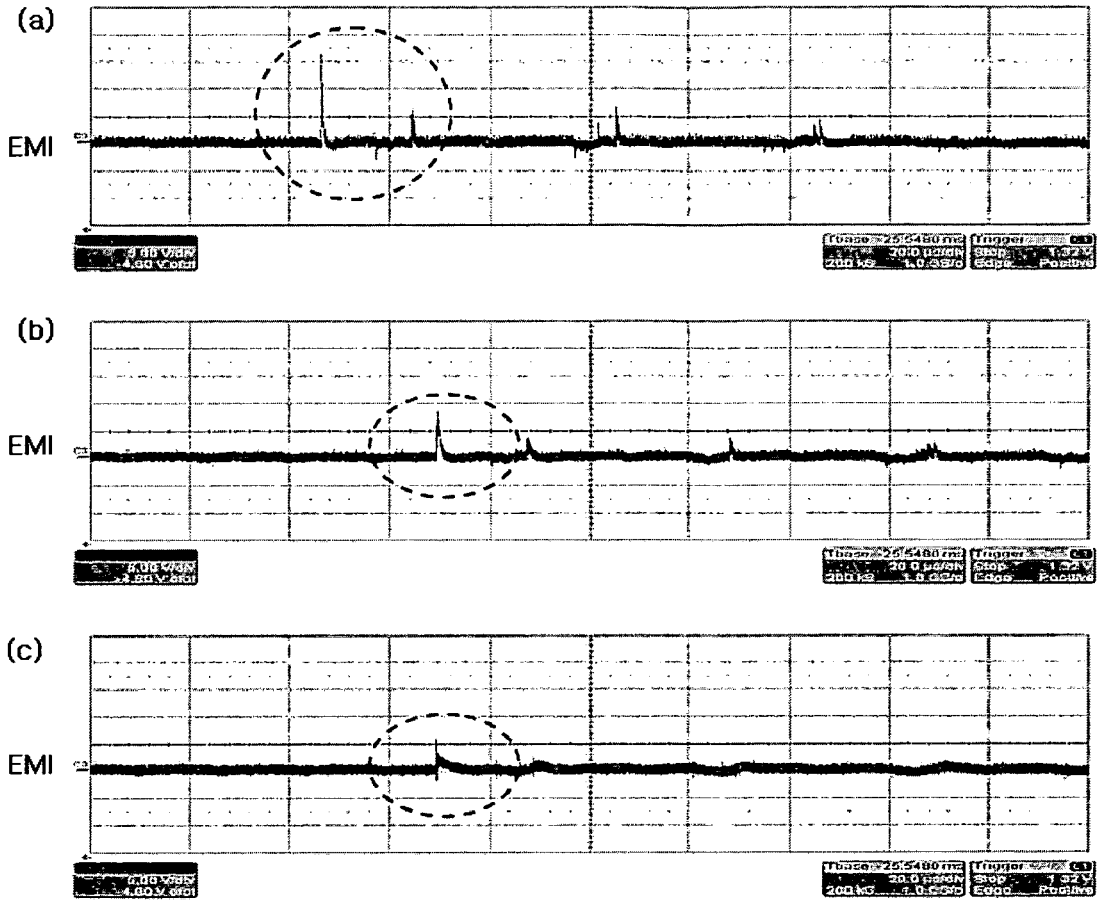
FIG. 8 illustrates EMI generated when the plasma display apparatus according to another embodiment of the present invention the plasma display apparatus.

FIG. 8 illustrates EMI generated when the plasma display apparatus according to another embodiment of the present invention the plasma display apparatus.

Referring to FIG. 8, (a) shows EMI generating during the address period in the related art, and (b) and (c) show EMI generating during the address period according to another embodiment of the present invention. (b) shows a case where capacitance of the second capacitor is 0.1 μF and (c) shows a case where capacitance of the second capacitor is 1.0 μF.

From a region indicated by a dotted line, it can be seen that EMI in (b) and (c) is reduced in comparison with (a) . More particularly, in the case of (c), i.e., generation of EMI can be significantly reduced when capacitance of the second capacitor is 1.0 μF rather than 0.1 μF.

Figure 9:
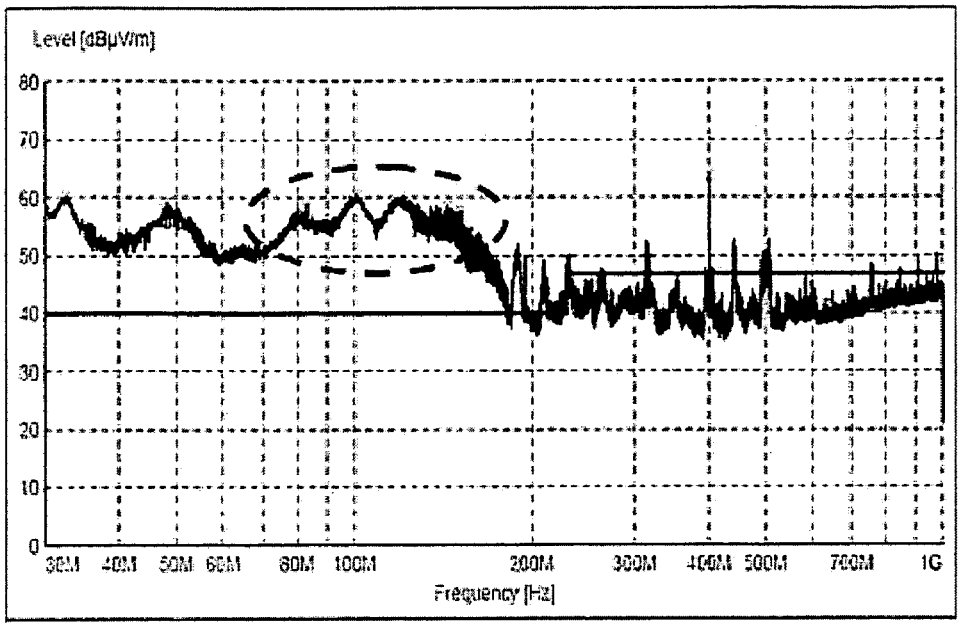
FIG. 9 illustrates a frequency band in which generation of EMI is prevented according to another embodiment of the present invention.
Figure 9:
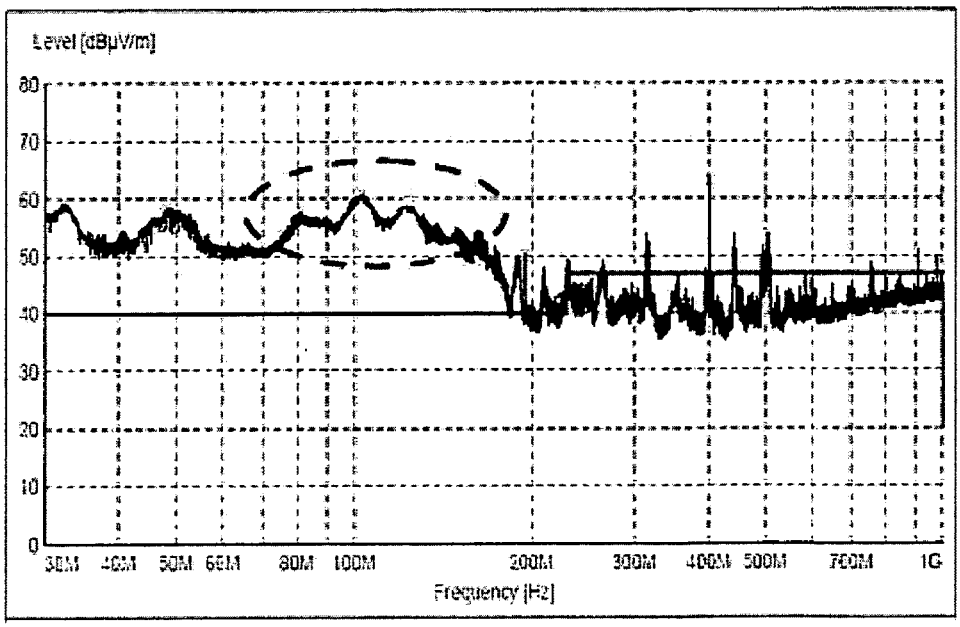

FIG. 9 illustrates a frequency band in which generation of EMI is prevented according to another embodiment of the present invention.

Referring to FIG. 9, (a) shows that EMI was generated at a frequency band of about 70 MHz to 150 MHz during the sustain period in the prior art plasma display apparatus and (b) shows that EMI was reduced at a frequency band of about 70 MHz to 150 MHz by using the second capacitor having capacitance of about 0.1 μF to 1.0 μF in the plasma display apparatus according to another embodiment of the present invention. More particularly, in the case where the second capacitor having capacitance of 1.0 μF is used, EMI generated during the sustain period can be reduced to about 1 dB μV/m in comparison with the prior art plasma display apparatus.

An example of reducing a current peaking component generated when a set-up voltage and a sustain voltage are applied will be described below with reference to FIGS. 10 to 12.

Figure 10:
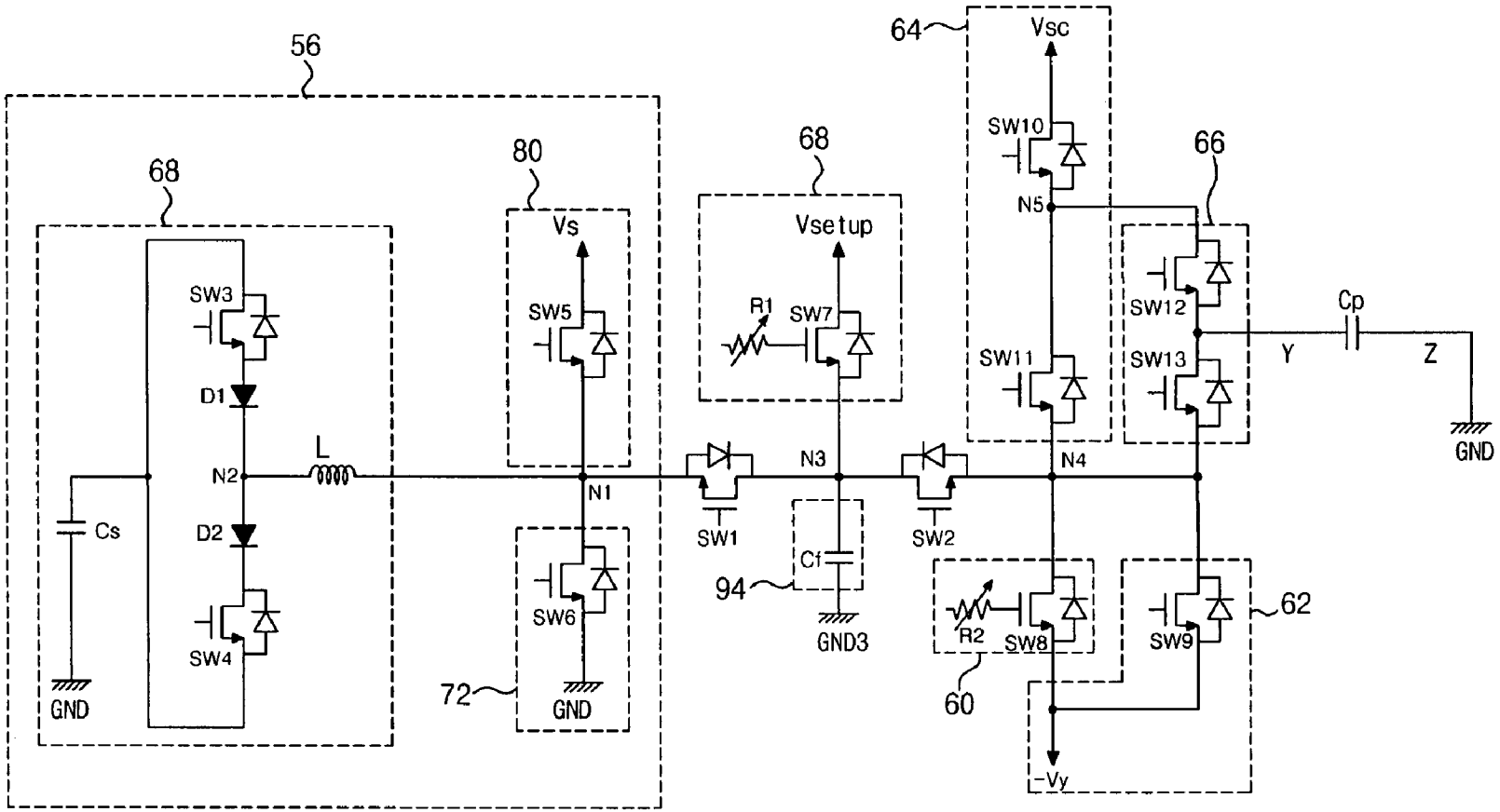
FIG. 10 illustrates a scan driver according to still another embodiment of the present invention.

FIG. 10 illustrates a scan driver according to still another embodiment of the present invention.

Referring to FIG. 10, the scan driver according to still another embodiment of the present invention comprises a sustain pulse supply unit 56 that supplies a sustain pulse having a voltage level of the sustain voltage (Vs) and the ground voltage (GND) in which a peaking component of a high frequency current has been filtered to a scan electrode Y of a panel capacitor Cp, a set-up voltage supply unit 68 that supplies the set-up voltage (Vsetup) in which a peaking component of a high frequency current has been filtered to the scan electrode Y of the panel capacitor Cp, and a scan voltage supply unit 62 that supplies a negative scan voltage (−Vy) to the scan electrode Y of the panel capacitor Cp. The scan driver further comprises a set-down voltage supply controller 60 that controls a ramp-down pulse, which falls from the sustain voltage (Vs) to the scan voltage (−Vy), to the scan electrode Y of the panel capacitor Cp, a scan reference voltage supply unit 64 that supplies a scan reference voltage (Vsc) to the scan electrode Y of the panel capacitor Cp, and an scan IC 66, a first switch SW1 and a second switch SW2 that are connected in a push-pull form between the scan voltage supply unit 62, the scan reference voltage supply unit 64 and the scan electrode Y of the panel capacitor Cp.

A sustain voltage supply unit 80 and the set-up voltage supply unit 68 according to still another embodiment of the present invention supply the sustain voltage (Vs) and the set-up voltage (Vsetup) having a predetermined slant to a third node N3 during the set-up period of the reset period, so that a ramp-up waveform that rises from the sustain voltage (Vs) to a peak voltage (Vs+Vsetup) at a predetermined slant is supplied to the scan electrode Y of the panel capacitor Cp.

A third capacitor 94 is connected between a third node N3, a common terminal of the sustain voltage supply unit 80 and the set-up voltage supply unit 68, and a third ground voltage source GND3. In this case, it has bee described that the third capacitor according to still another embodiment of the present invention is directly connected between the set-up voltage supply unit 68 and the third ground voltage source GND3. However, the third capacitor can be connected between the set-up voltage supply unit 68 and the third ground voltage source GND3, including at least one electrical element, if appropriate. If a sustain pulse and a ramp-up waveform are supplied to the scan electrode Y of the panel capacitor Cp using the third capacitor 94, generation of EMI toward the front of the plasma display panel 32 can be prevented. The third capacitor 94 comprises at least one or more film capacitors Cf.

the number, a connection form when being plural in number, a filtered frequency band, the range of capacitance and so on, of the third capacitor 94, are substantially the same as those of the first capacitor 74 shown in FIG. 4 or the second capacitor 84 shown in FIG. 7.

The third capacitor 94 according to still another embodiment of the present invention filters a frequency band of about 20 MHz to 60 MHz, thus filtering a peaking component of a high frequency current generated by the set-up voltage (Vsetup) and the sustain voltage (Vs). To this end, the third capacitor can have capacitance of about 0.5 μF to 6.0 μF.

As described above, the plasma display apparatus according to still another embodiment of the present invention can reduce EMI generated in the set-up period and the sustain period by filtering a peaking component of a high frequency current of the set-up voltage (Vsetup) and the sustain voltage (Vs). The remaining constituent elements have substantially the same operating characteristic of the scan driver according to an embodiment of the present invention of FIG. 4. Therefore, description thereof will be omitted for simplicity.

Figure 11:
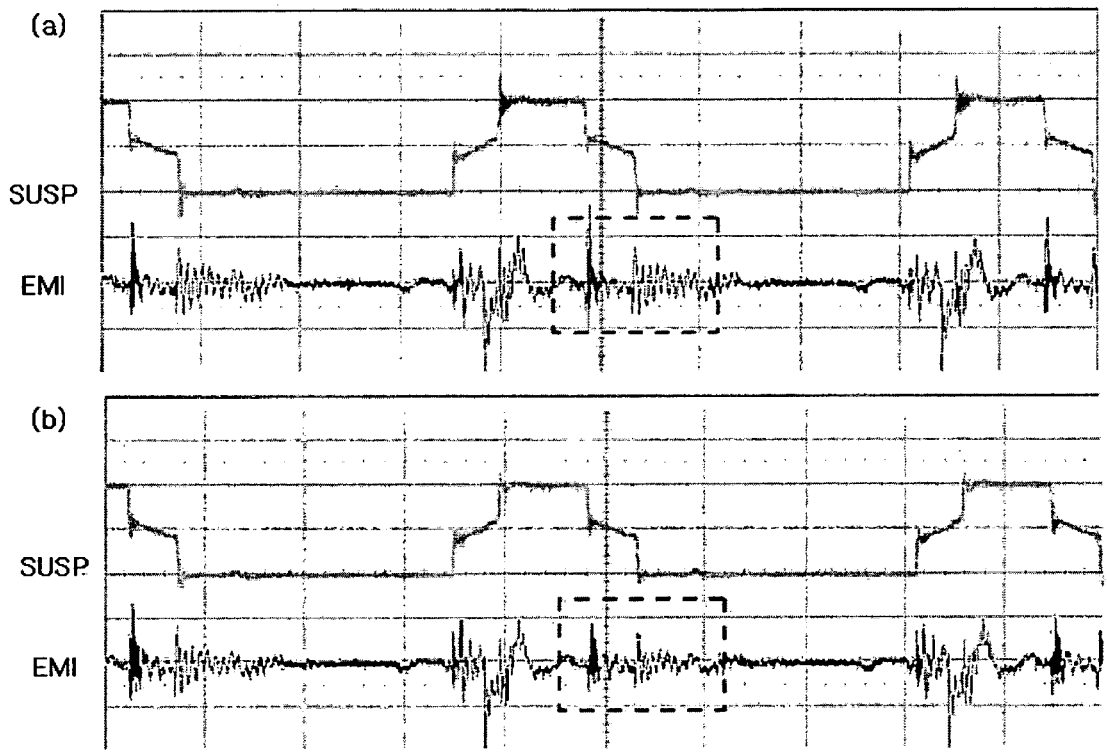
FIG. 11 illustrates EMI generated when the plasma display apparatus according to still another embodiment of the present invention.

FIG. 11 illustrates EMI generated when the plasma display apparatus according to still another embodiment of the present invention.

Referring to FIG. 11, (a) shows EMI generated by the sustain voltage (SUS) in the related art, and (b) shows EMI generated by the sustain voltage (SUS) according to still another embodiment of the present invention. Capacitance of the third capacitor of (b) is 6.0 nF.

From a region indicated by a dotted line, it can be seen that EMI in (b) is reduced in comparison with (a).

Figure 12:
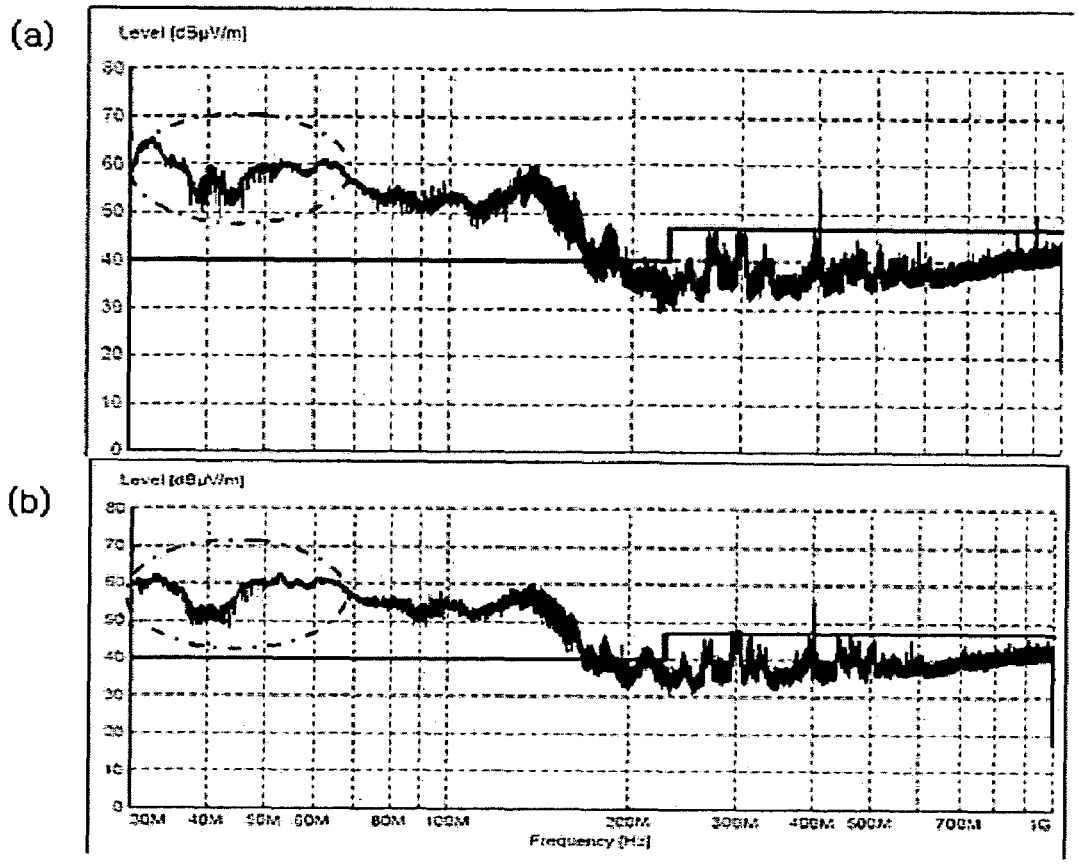
FIG. 12 illustrates a frequency band in which generation of EMI is prevented according to still another embodiment of the present invention.

FIG. 12 illustrates a frequency band in which generation of EMI is prevented according to still another embodiment of the present invention.

Referring to FIG. 12, (a) shows that EMI was generated at a frequency band of about 20 MHz to 60 MHz in the prior art plasma display apparatus, and (b) shows that EMI was reduced at a frequency band of about 20 MHz to 60 MHz by using the third capacitor having capacitance of about 0.5 μF to 6.0 μF in the plasma display apparatus according to still another embodiment of the present invention. More particularly, in the case where the third capacitor having capacitance of 6.0 μF is used, EMI can be reduced to about 5 dB μV/m in comparison with the prior art plasma display apparatus.

Meanwhile, in FIGS. 4 to 12, operating characteristics and an EMI prevention effect of the scan drivers respectively having the first to third capacitors have been described separately taking each of the scan drivers as an example. EMI can be reduced more effectively if two of the first to third capacitors are combined in constructing the scan driver.

More particularly, an optimal effect can be expected by including all the first to third capacitors in one scan driver. Furthermore, an optimal EMI reduction effect can be expected by filtering a peaking component of a high frequency current generated in the entire driving periods, i.e., the reset period, the address period and the sustain period. In this case, the first capacitor and the second capacitor can have capacitance of about 0.1 μF to 2 μF, and the third capacitor can have capacitance of about 0.5 nF to 6.0 nF.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising an electrode; and at least one of a first capacitor connected between a sustain voltage source for supplying a sustain voltage to the electrodes and a first ground voltage source, a second capacitor connected between a scan voltage source for supplying a scan voltage to the electrodes and a second ground voltage source, and a third capacitor connected between a set-up voltage source for supplying a set-up voltage to the electrodes and a third ground voltage source, wherein the first capacitor or the second capacitor filters a frequency band of about 70 MHz to 150 MHz.

2. The plasma display apparatus of claim 1, wherein at least one of the first capacitor, the second capacitor, or the third capacitor comprises at least one electrical element.

3. The plasma display apparatus of claim 1, wherein at least one of the first capacitor, the second capacitor, or the third capacitor comprises a film capacitor.

4. The plasma display apparatus of claim 1, wherein each of the first capacitor, the second capacitor,or the third capacitor comprises at least one capacitor.

5. The plasma display apparatus of claim 4, wherein at least one of the first capacitor, the second capacitor, or the third capacitor is a capacitive circuit that includes one or more capacitor or that has a capacitance corresponding to a predetermined a frequency band of current.

6. The plasma display apparatus of claim 1, wherein the plasma display panel comprises:

a plurality of display electrodes comprising a scan electrode and a sustain electrode arranged in a front substrate;

an upper dielectric layer formed on the display electrodes;

a plurality of address electrodes arranged in a rear substrate coupled to the front substrate in a direction crossing the display electrodes;

a lower dielectric layer formed on the address electrodes;

a plurality of barrier ribs arranged in the rear substrate, for partitioning a discharge space; and phosphors coated between the barrier ribs.

7. The plasma display apparatus of claim 1, wherein at least one of the first capacitor, the second capacitor, or the third capacitor is a capacitive circuit that includes one or more capacitors or that has a capacitance corresponding to a predetermined a frequency band of current.

8. The plasma display apparatus of claim 1, wherein the set-up voltage source is commonly connected with the sustain voltage source.

9. A plasma display apparatus, comprising:

a plasma display panel comprising an electrode; and at least one of a first capacitor connected between a sustain voltage source for supplying a sustain voltage to the electrodes and a first ground voltage source, a second capacitor connected between a scan voltage source for supplying a scan voltage to the electrodes and a second ground voltage source, and a third capacitor connected between a set-up voltage source for supplying a set-up voltage to the electrodes and a third ground voltage source, wherein the third capacitor filters a frequency band of about 20 MHz to 60 MHz.

10. A plasma display apparatus comprising:

a plasma display panel comprising an electrode; and at least one of a first capacitor, connected between a sustain voltage source for supplying a sustain voltage to the electrodes and a first ground voltage source, has a capacitance of about 0.1 μF to 2 μF, a second capacitor connected, between a scan voltage source for supplying a scan voltage to the electrodes and a second ground voltage source, has a capacitance of about 0.1 μF to 2 μF, or a third capacitor, connected between a set-up voltage source for supplying a set-up voltage to the electrodes and a third ground voltage source, has capacitance of about 0.5 μF to 6.0 μF, wherein the first capacitor or the second capacitor filters a frequency band of about 70 MHz to 150 MHz.

11. The plasma display apparatus of claim 10, wherein at least one of the first capacitor, the second capacitor, or the third capacitor comprises at least one electrical element.

12. The plasma display apparatus of claim 10, wherein at least one of the first capacitor, the second capacitor, or the third capacitor comprises a film capacitor.

13. The plasma display apparatus of claim 10, wherein each of the first capacitor, the second capacitor and the third capacitor comprises at least one capacitor.

14. The plasma display apparatus of claim 10, wherein at least one of the first capacitor, the second capacitor, or the third capacitor is a capacitive circuit that includes one or more capacitors or that has a capacitance corresponding to a predetermined frequency band of current.

15. The plasma display apparatus of claim 10, wherein the plasma display panel comprises:

a plurality of display electrodes comprising a scan electrode and a sustain electrode arranged in a front substrate;

an upper dielectric layer formed on the display electrodes;

a plurality of address electrodes arranged in a rear substrate coupled to the front substrate in a direction crossing the display electrodes;

a lower dielectric layer formed on the address electrodes;

a plurality of barrier ribs arranged in the rear substrate, for partitioning a discharge space; and phosphors coated between the barrier ribs.

16. The plasma display apparatus of claim 15, wherein at least one of the first capacitor, the second capacitor, or the third capacitor has a capacitance that corresponds to a predetermined frequency band to be filtered.

17. The plasma display apparatus of claim 10, wherein the set-up voltage source is commonly connected with the sustain voltage source.

18. A plasma display apparatus, comprising:

a plasma display panel comprising an electrode; and at least one of a first capacitor, connected between a sustain voltage source for supplying a sustain voltage to the electrodes and a first ground voltage source, has a capacitance of about 0.1 μF to 2 μF, a second capacitor connected, between a scan voltage source for supplying a scan voltage to the electrodes and a second ground voltage source, has a capacitance of about 0.1 μF to 2 μF, or a tbird capacitor, connected between a set-up voltage source for supplying a set-up voltage to the electrodes and a third ground voltage source, has capacitance of about 0.5 μF to 6.0 μF, wherein the third capacitor filters a frequency band of about 20 MHz to 60 MHz.

* * * * *